US008953960B2

(12) United States Patent
Ueno et al.

(10) Patent No.: US 8,953,960 B2
(45) Date of Patent: Feb. 10, 2015

(54) FIXING DEVICE AND IMAGE FORMING APPARATUS

(75) Inventors: Satoshi Ueno, Tokyo (JP); Masanao Ehara, Kanagawa (JP); Tadashi Ogawa, Tokyo (JP); Teppei Kawata, Kanagawa (JP); Takamasa Hase, Kanagawa (JP); Kazuya Saito, Kanagawa (JP); Shuutaroh Yuasa, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 312 days.

(21) Appl. No.: 13/221,340

(22) Filed: Aug. 30, 2011

(65) Prior Publication Data

US 2012/0051766 A1 Mar. 1, 2012

(30) Foreign Application Priority Data

Aug. 30, 2010 (JP) ..... 2010-192558

(51) Int. Cl.
*G03G 15/00* (2006.01)
*G03G 15/20* (2006.01)

(52) U.S. Cl.
CPC ..... *G03G 15/205* (2013.01)
USPC ..... 399/45; 399/69; 399/70; 399/334

(58) Field of Classification Search
USPC ..... 399/44, 45, 67, 69, 70, 334
See application file for complete search history.

(56) References Cited

U.S. PATENT DOCUMENTS 5,287,155 A 2/1994 Arai et al.
7,266,336 B2 9/2007 Ueno et al.
7,450,872 B2 11/2008 Ueno et al.
7,491,917 B2 2/2009 Ueno
7,509,085 B2 3/2009 Yoshinaga et al.
7,546,049 B2 * 6/2009 Ehara et al. ..... 399/69
7,693,439 B2 4/2010 Seo et al.
7,715,774 B2 5/2010 Ueno
7,734,208 B2 6/2010 Seo et al.

(Continued)

FOREIGN PATENT DOCUMENTS

JP 04296889 A * 10/1992
JP 2968054 8/1999

(Continued)

OTHER PUBLICATIONS

Shirosugi (JP 2002-244483 A; Aug. 2002) JPO Machine Translation.*

(Continued)

*Primary Examiner* — Erika J Villaluna
(74) *Attorney, Agent, or Firm* — Oblon, Spivak, McClelland, Maier & Neustadt, L.L.P.

(57) ABSTRACT

A fixing device includes a fixing rotation body heating and fixing an unfixed image onto a recording medium; a pressing rotation body pressing the recording medium to the fixing rotation body; a first temperature detection unit detecting a temperature of the fixing rotation body; and plural second temperature detection units detecting a temperature of the pressing rotation body. Further the fixing device selects a predetermined second temperature detection unit from the plural second temperature detection units depending on an operation mode of the fixing device, and the fixing device detects the temperature of the pressing rotation body by using the predetermined second temperature detection unit selected by the fixing device.

11 Claims, 8 Drawing Sheets

(56) References Cited

U.S. PATENT DOCUMENTS

| | | | |
|---|---|---|---|
| 7,778,581 | B2 | 8/2010 | Seo et al. |
| 7,783,240 | B2 | 8/2010 | Ito et al. |
| 7,796,933 | B2 | 9/2010 | Ueno et al. |
| 7,801,457 | B2 | 9/2010 | Seo et al. |
| 7,817,952 | B2 | 10/2010 | Seo et al. |
| 7,885,590 | B2 | 2/2011 | Seo et al. |
| 7,925,177 | B2 | 4/2011 | Ishii et al. |
| 7,983,582 | B2 | 7/2011 | Hase |
| 2007/0014600 | A1 | 1/2007 | Ishii et al. |
| 2007/0280754 | A1 | 12/2007 | Ogawa et al. |
| 2008/0025773 | A1 | 1/2008 | Ito et al. |
| 2008/0063443 | A1 | 3/2008 | Yoshinaga et al. |
| 2008/0317532 | A1 | 12/2008 | Ehara et al. |
| 2009/0123201 | A1 | 5/2009 | Ehara et al. |
| 2009/0245897 | A1 | 10/2009 | Seo et al. |
| 2010/0014903 | A1 | 1/2010 | Seto et al. |
| 2010/0061753 | A1 | 3/2010 | Hase |
| 2010/0074667 | A1 | 3/2010 | Ehara et al. |
| 2010/0158553 | A1 | 6/2010 | Ueno |
| 2010/0232844 | A1 | 9/2010 | Saito et al. |
| 2010/0239292 | A1 | 9/2010 | Fujita et al. |
| 2010/0303521 | A1 | 12/2010 | Ogawa et al. |
| 2011/0026988 | A1 | 2/2011 | Yoshikawa et al. |
| 2011/0044706 | A1 | 2/2011 | Iwaya et al. |
| 2011/0044734 | A1 | 2/2011 | Shimokawa et al. |
| 2011/0052237 | A1 | 3/2011 | Yoshikawa et al. |
| 2011/0052277 | A1 | 3/2011 | Ueno et al. |
| 2011/0058862 | A1 | 3/2011 | Yamaguchi et al. |
| 2011/0058863 | A1 | 3/2011 | Shinshi et al. |
| 2011/0064443 | A1 | 3/2011 | Iwaya et al. |
| 2011/0064451 | A1 | 3/2011 | Yamaguchi et al. |
| 2011/0064490 | A1 | 3/2011 | Imada et al. |
| 2011/0064502 | A1 | 3/2011 | Hase et al. |
| 2011/0085832 | A1 | 4/2011 | Hasegawa et al. |
| 2011/0091253 | A1 | 4/2011 | Seo et al. |
| 2011/0116848 | A1 | 5/2011 | Yamaguchi et al. |
| 2011/0129268 | A1 | 6/2011 | Ishii et al. |
| 2011/0150518 | A1 | 6/2011 | Hase et al. |
| 2011/0176821 | A1 | 7/2011 | Hase |
| 2011/0176822 | A1 | 7/2011 | Ishii et al. |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206427 | A1 | 8/2011 | Iwaya et al. |

FOREIGN PATENT DOCUMENTS

| | | | |
|---|---|---|---|
| JP | 2000-194228 | | 7/2000 |
| JP | 2002244483 A | * | 8/2002 |
| JP | 3478761 | | 10/2003 |
| JP | 2006-47393 | | 2/2006 |
| JP | 3777722 | | 3/2006 |
| JP | 2010-66347 | | 3/2010 |

OTHER PUBLICATIONS

U.S. Appl. No. 13/212,718, filed Aug. 18, 2011, Hase, et al.
U.S. Appl. No. 13/041,703, filed Mar. 7, 2011, Tadashi Ogawa, et al.
U.S. Appl. No. 13/041,567, filed Mar. 7, 2011, Kazuya Saito.
U.S. Appl. No. 13/048,167, filed Mar. 15, 2011, Takahiro Imada, et al.
U.S. Appl. No. 13/049,181, filed Mar. 16, 2011, Masanao Ehara, et al.
U.S. Appl. No. 13/016,342, filed Jan. 28, 2011, Tetsuo Tokuda, et al.
U.S. Appl. No. 13/028,597, filed Feb. 16, 2011, Kenji Ishii, et al.
U.S. Appl. No. 12/929,930, filed Feb. 25, 2011.
U.S. Appl. No. 13/041,729, filed Mar. 7, 2011, Naoki Iwaya, et al.
U.S. Appl. No. 13/042,706, filed Mar. 8, 2011, Tetsuo Tokuda, et al.
U.S. Appl. No. 12/929,915, filed Feb. 24, 2011.
U.S. Appl. No. 13/064,201, filed Mar. 10, 2011.
U.S. Appl. No. 13/064,137, filed Mar. 8, 2011.
U.S. Appl. No. 13/064,105, filed Mar. 7, 2011.
U.S. Appl. No. 12/929,961, filed Feb. 28, 2011.
U.S. Appl. No. 13/049,330, filed Mar. 16, 2011, Satoshi Ueno, et al.
U.S. Appl. No. 13/024,736, filed Feb. 10, 2011, Kenji Ishii, et al.
U.S. Appl. No. 13/027,595, filed Feb. 15, 2011, Ippei Fujimoto, et al.
U.S. Appl. No. 13/029,794, filed Feb. 17, 2011, Akira Shinshi, et al.
U.S. Appl. No. 13/045,182, filed Mar. 10, 2011, Masaaki Yoshikawa, et al.
U.S. Appl. No. 13/044,970, filed Mar. 10, 2011, Masaaki Yoshikawa, et al.
U.S. Appl. No. 13/097,711, filed Apr. 29, 2011, Toshihiko Shimokawa, et al.
U.S. Appl. No. 13/161,929, filed Jun. 16, 2011, Hiroshi Seo, et al.
Office Action issued Feb. 4, 2014 in Japanese Patent Application No. 2010-192558.

* cited by examiner

FIXING DEVICE AND IMAGE FORMING APPARATUS

CROSS-REFERENCE TO RELATED APPLICATIONS

The present application claims priority under 35 U.S.C. §119 to Japanese Patent Application No. 2010-192558 filed Aug. 30, 2010, the entire contents of which are hereby incorporated herein by reference

BACKGROUND OF THE INVENTION

1. Field of the Invention

The present invention generally relates to a fixing device fixing an unfixed image onto a recording medium and an image forming apparatus including the fixing device.

2. Description of the Related Art

An image forming apparatus such as a copier, a facsimile machine, a printer, and a printing machine has been used to obtain a copy or recorded medium by fixing (i.e., heating and pressing) an unfixed image onto a recording medium, the unfixed image having been transferred and carried on the recording medium. In the fixing, the recording medium on which the unfixed image is carried is heated and pressed while being fed and sandwiched, so that a developer, especially toner, included in the unfixed image is melted and softened to penetrate into the recording medium. By doing this, the toner may be fixed into the recording medium.

In such a image forming apparatus, in order to reduce a warm-up time and reduce energy consumption, there is a demand for improving accuracy of temperature control. To that end, there is a demand for improving detection accuracy of internal temperature sensors. As a temperature sensor to detect the temperature of a fixing roller (of a fixing device), a thermopile is generally used due to higher accuracy. On the other hand, as a temperature sensor to detect the temperature of a pressing roller (of the fixing device), a non-contact-type thermistor having lower detection accuracy than that of the thermopile may be used. There are various methods of performing temperature control in an image forming apparatus. Some of the methods are briefly described below.

Japanese Patent No. 3478761 discloses a technique in which a non-contact-type temperature sensor includes a thermopile and a thermistor to detect the temperature of the non-contact-type temperature sensor. Then, a temperature increase of the thermistor and a temperature increase of the thermopile are compared. Based on the comparison result, a degree of contamination on the surface of the non-contact-type temperature sensor is detected and a temperature compensation is performed.

Further, Japanese Patent No. 2968054 discloses a technique in which there is a switching unit that changes the position of a thermistor between a contacting position where the thermistor is in contact with the fixing roller and a non-contacting position where the thermistor is not in contact with the fixing roller. The thermistor is in contact with the fixing roller during a warm-up time and a standby more where the fixing roller does not rotate and measures the temperature of the fixing roller. On the other hand, during the recording medium is fed (i.e., during the fixing roller rotates), the thermistor detects the temperature of the fixing roller while being separated from the fixing roller. By operating the thermistor in this way, it becomes possible to prevent the damage of the surface of the fixing roller by the thermistor.

Further, Japanese Patent No. 3777722 discloses a technique in which a non-contact type first temperature sensor is disposed at a position corresponding to a sheet feeding region of the fixing roller, and a contact-type second temperature sensor is disposed at a position corresponding to a non-sheet feeding region of the fixing roller. Whether the warm-up operation is finished is determined by using the second temperatures sensor corresponding to the non-sheet feeding region. On the other hand, while a recording medium is being fed, the first temperature sensor corresponding to the sheet feeding region is used for temperature control. During the warm-up operation, the non-contact type first temperature sensor is used. Therefore, it becomes possible to eliminate an influence due to the contamination of the surface of the non-contact type first temperature sensor. As a result, unnecessary extension of the warm-up time may be prevented.

Further, Japanese Patent Application Publication No. 2000-194228 discloses a technique in which plural sensors having different temperature characteristics from each other are disposed close to the fixing roller, so that an appropriate sensor is selected depending on the use temperature. As a result, it becomes possible to accurately detect a temperature in any of the temperatures ranges.

SUMMARY OF THE INVENTION

According to an aspect of the present invention, a fixing device includes a fixing rotation body in contact with a side of a recording medium, an unfixed image having been formed on the side of the recording medium, and heating and fixing the unfixed image onto the recording medium; a pressing rotation body in contact with another side of the recording medium, no unfixed image having been formed on the other side of the recording medium, and pressing the recording medium to the fixing rotation body; a first temperature detection unit detecting a temperature of the fixing rotation body; and plural second temperature detection units detecting a temperature of the pressing rotation body. Further, the fixing device selects a predetermined second temperature detection unit from the plural second temperature detection units depending on an operation mode of the fixing device, and the fixing device detects the temperature of the pressing rotation body by using the predetermined second temperature detection unit selected by the fixing device.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

Figure 1:
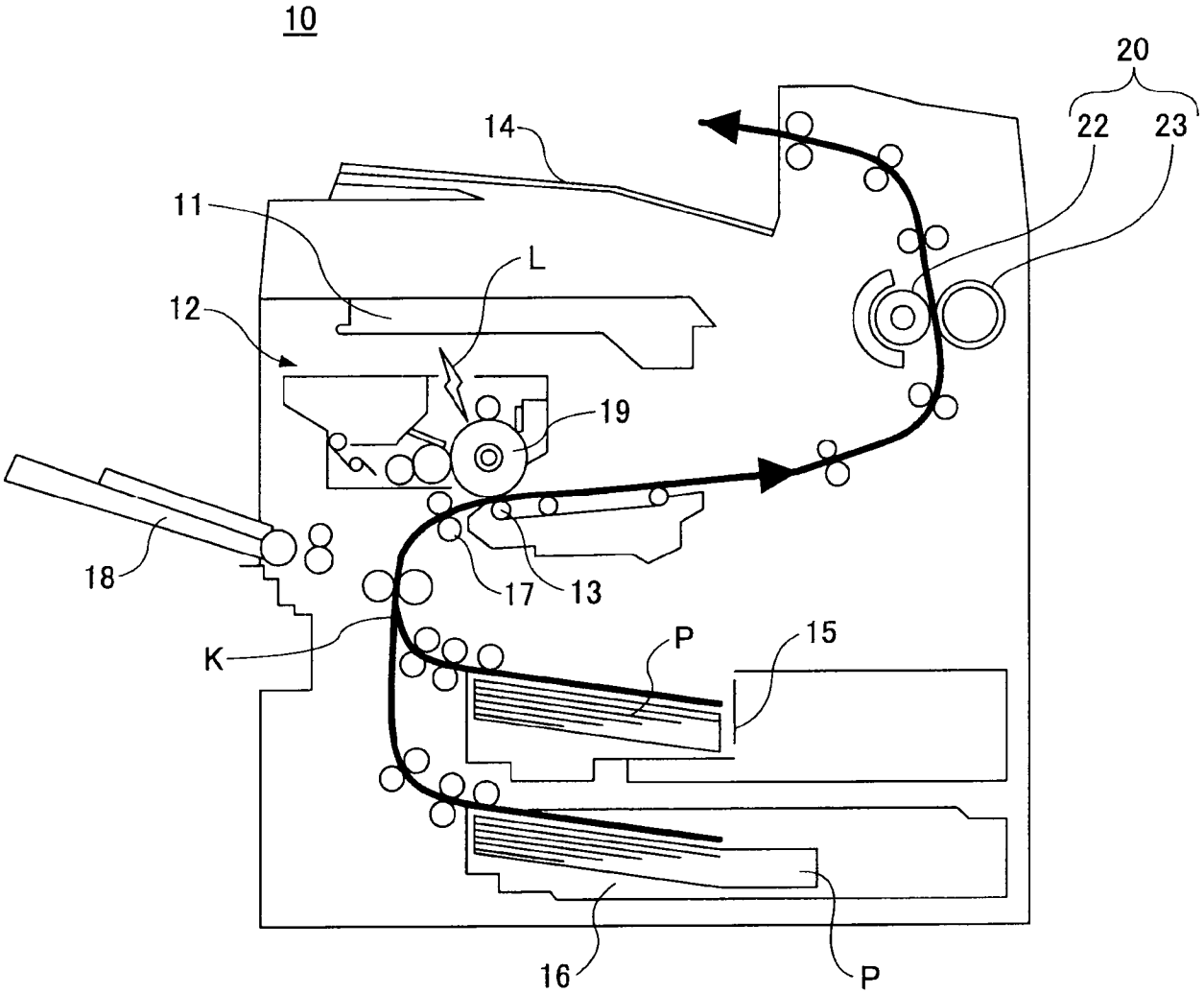
FIG. 1 is a drawing illustrating an image forming apparatus according to an embodiment of the present invention.

Generally, a fixing device has several operation modes including a warm-up mode, a sheet feeding mode, a standby mode and the like. To appropriately switch among those modes, it may be necessary to accurately detect a temperature in any temperature range.

Further, to successfully perform a fixing operation in the sheet feeding mode, it may be necessary to accurately determine whether sufficient heat is accumulated in a fixing roller of the fixing device. This is because, for example, even when the temperature of the surface of the fixing roller reaches a predetermined temperature, there may be a case where sufficient heat is not accumulated in the fixing roller (i.e., an insufficient heat accumulation status of the fixing roller). In this case, when the fixing operation starts, heat in the fixing roller is transferred quickly to the recording medium and the temperature of the surface of the fixing roller is reduced quickly. As a result, an appropriate fixing operation may not be performed. Therefore, it may be necessary to accurately determine (estimate) whether heat is sufficiently accumulated in the fixing roller and switch the operation mode from the warm-up mode to the sheet feeding mode based on a result of the determination (estimation).

However, in the related art, it is not considered to determine whether sufficient heat is accumulated in the fixing roller and accurately detect a temperature in any temperature range.

The present invention is made in light of the above circumstances, and may provide a fixing device that accurately detects a temperature in any temperature range and an image forming apparatus including the fixing device.

In the following, an embodiment of the present invention is described with reference to the accompanying drawings. In the figures, the same reference numerals and the same symbols are used to describe the same elements, and repeated description thereof may be omitted.

Configuration and Operation of Image Forming Apparatus

First, an exemplary configuration and operation of an image forming apparatus according to an embodiment of the present invention is described. FIG. 1 illustrates an image forming apparatus according to this embodiment of the present invention. As illustrated in FIG. 1, an image forming apparatus 10 includes an exposure section 11, a process cartridge 12, a transfer section 13, a discharge tray 14, sheet feeding sections 15 and 16, a resist roller 17, a manual sheet feeding section 18, a photosensitive drum 19, a fixing device 20 and a controller (not shown). For example, the image forming apparatus 10 is a printer.

The exposure section 11 radiates exposure light L corresponding to image information onto the photosensitive drum 19. The process cartridge 12 serves as an image forming section and is removably provided in the image forming apparatus 10. The transfer section 13 transfers a toner image formed on the photosensitive drum 19 onto a recording medium P such as a transfer sheet. The discharge tray 14 is used to place an output image (recording medium P on which the toner image is fixed). The sheet feeding sections 15 and 16 are used to contain the recording media P. The resist roller 17 feeds the recording medium P to the transfer section 13. The manual sheet feeding section 18 is used to, for example, feed a recording medium having a size different from that of the recording medium P contained in the sheet feeding sections 15 and 16. The fixing device 20 includes a fixing sleeve 22 and a pressing roller 23, and fixes an unfixed image which is formed on the recording medium P onto the recording medium P.

Next, a typical image forming operation of forming an image in the image forming apparatus 10 is briefly described. First, the exposure light L such as laser light corresponding to the image information is radiated from the exposure section 11 (writing section) onto the photosensitive drum 19 of the exposure section 11. The exposure section 11 rotates in the counterclockwise direction. After predetermined processes (e.g., charging, exposing, and developing processes) are performed, a toner image corresponding to the image information is formed on the photosensitive drum 19. After that, in the transfer section 13, the toner image formed on the photosensitive drum 19 is transferred onto the recording medium P which is fed by the resist roller 17.

On the other hand, the recording medium P to be fed to the transfer section 13 is operated as in the following. First, one of the sheet feeding sections 15 and 16 is automatically or manually selected. Herein, it is assumed that the uppermost sheet feeding section 15 is selected. The sheet feeding sections 15 and 16 may contain recording media P having respective sizes different from each other. Otherwise, for example, the sheet feeding sections 15 and 16 may contain recording media P having the same size but having different feeding directions from each other.

Then, one recording medium P on the top of the recording media P contained in the sheet feeding section 15 is fed to the position on the feeding path K of FIG. 1. After that, the recording medium P passes through the feeding path K and is fed to the position of the resist roller 17. The recording medium P at the position of the resist roller 17 is further fed to the transfer section 13 at an appropriate timing to align with the printing position of the toner image formed on the photosensitive drum 19.

After the transfer process, after passing through the position of the transfer section 13, the recording medium P further passes through the feeding path K to be fed to the fixing device 20. The recording medium P fed to the fixing device 20 is further fed into a nip (nip section) between the fixing sleeve 22 and the pressing roller 23. Due to the heat from the fixing sleeve 22 and the pressure from the pressing roller 23, the toner image is fixed onto the recording medium P. The recording medium P onto which the toner image is fixed is fed from the nip between the fixing sleeve 22 and the pressing roller 23, and is ejected from the image forming apparatus 10 to the position on the discharge tray 14 as an output image (i.e., recording medium P onto which the toner image has been fixed).

Further, the controller (not shown) performs various controls on the image forming apparatus 10 including the fixing device 20 including various temperature sensors (temperature detection unit) described below. For example, the controller (not shown) includes a CPU, a ROM, a main memory and the like, so that various functions of the controller are realized by loading the corresponding programs recorded in the ROM or the like to the main memory and executing the loaded programs by using the CPU. However, a part or all of the controller (not shown) may be realized only by hardware. Further, the controller (not shown) may be constituted by plural devices which are physically different from each other.

As described above, a series of the image forming processes is finished. In the above description, a case is described where the image forming apparatus 10 prints a single color. However, for example, the image forming apparatus 10 may be a full-color printer by replacing the process cartridge 12 with a process cartridge corresponding to four colors (i.e. KCMY).

Configuration and Operation of Fixing Device

Figure 2:
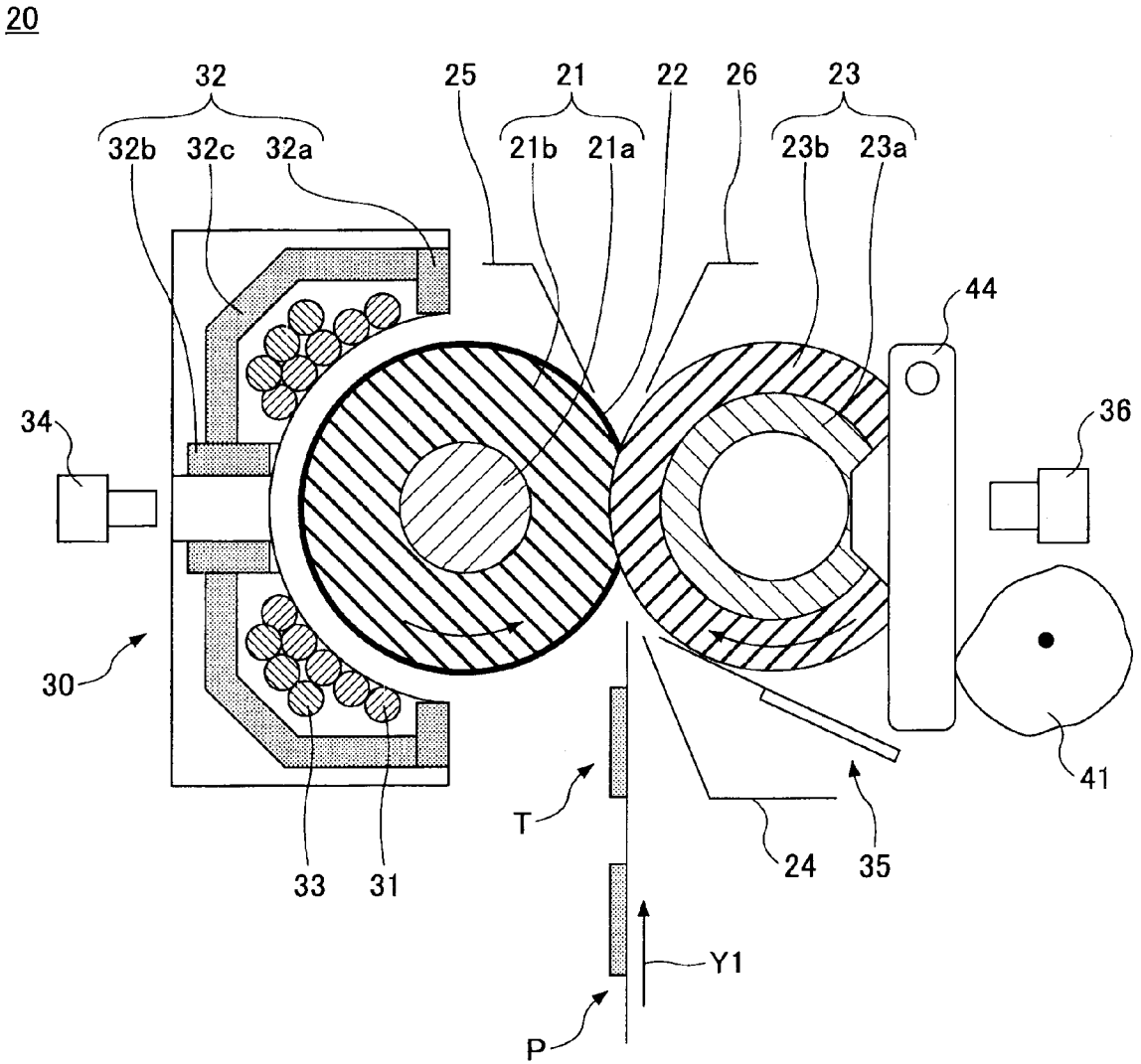
FIG. 2 is a drawing illustrating an example of a fixing device according to the embodiment of the present invention.
Figure 3:
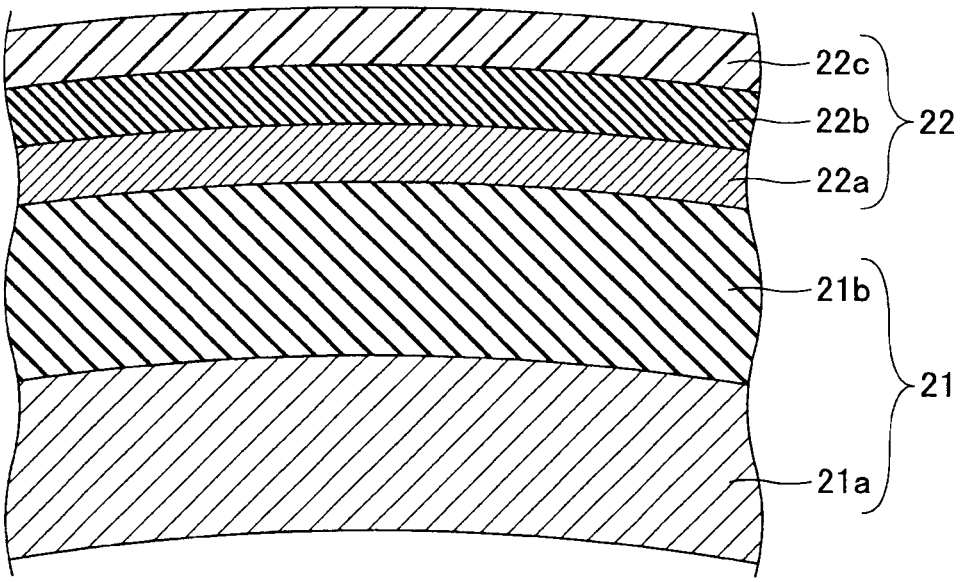
FIG. 3 is an enlarged drawing of a fixing roller and a fixing sleeve in FIG. 2.

Next, a configuration and operations of the fixing device 20 according to an embodiment of the present invention is described. FIG. 2 illustrates an example of the fixing device 20 according to an embodiment of the present invention. FIG. 3 is an enlarged drawing illustrating the fixing roller 21 and the fixing sleeve 22. As illustrated in FIGS. 2 and 3, the fixing device 20 includes the fixing roller 21, the fixing sleeve 22, the pressing roller 23, an induction heater 30, a thermopile 34, a contact-type thermistor 35, a non-contact-type thermistor 36 and the like. Herein, the symbol "T" denotes a toner image (toner) of an unfixed image (hereinafter may be referred to as "toner image T").

The fixing sleeve 22 is provided to be in contact with a side (surface) of the recording medium P, the toner image T (i.e., unfixed image) being formed on the side, so that the fixing sleeve 22 heats and fixes the toner image T onto the recording medium P. The fixing sleeve 22 includes a base material 22*a*, an elastic layer 22*b*, and a release layer 22*c*. The base material 22*a* is made of a metal material and has a thickness in a range, for example, from 30 μm to 50 μm. The elastic layer 22*b* and the release layer 22*c* are sequentially formed on the surface of the base material 22*a*. For example, the outer diameter of the fixing sleeve 22 is 40 mm. As a material of forming the base material 22*a*, for example, magnetic metal materials such as Fe, Co, Ni, and an alloy which is any combination thereof may be used. For example, the elastic layer 22*b* may be made of an elastic member such as silicone rubber and has a thickness of 150 μm. By using the base material 22*a* and the elastic layer 22*b* described above, it may become possible to determine a heat capacity of the fixing roller 21 in an appropriate range and obtain a fixed image having good quality without irregular fixing (fixing failure) occurring. The release layer 22*c* is made of a fluoride compound such as PFA (polytetrafluoroethylene) and has a tube-like shape for coating. For example, the thickness of the release layer 22*c* is 50 μm. The release layer 22*c* is provided to enhance the release performance of the toner on the surface of the fixing sleeve 22, the toner image (toner) T being in direct contact with the surface of the fixing sleeve 22.

The fixing roller 21 holds the fixing sleeve 22. The fixing roller 21 includes a core metal 21*a* and an elastic layer 21*b*. The core metal 21*a* is made of a metal material such as stainless steel and has a cylindrical shape. The elastic layer 21*b* is made of a thermally-resistant material such as silicone foam. For example, the outer diameter of the fixing roller 21 is 40 mm. For example, the thickness of the elastic layer 21*b* is 9 mm, and Asker hardness of the elastic layer 21*b* is in a range from 30 degrees to 50 degrees. The fixing roller 21 is in contact with the inner periphery of the fixing sleeve 22 so as to hold the fixing sleeve 22 like a roller. The fixing roller 21 and the fixing sleeve 22 constitute one typical example of a fixing rotation body according to an embodiment of the present invention.

The pressing roller 23 is provided to be in contact with another side of the recording medium P, no toner image T (unfixed image) being formed on the other side. The pressing roller 23 presses the recording medium P toward the side of the fixing sleeve 22. In a case where the unfixed image is to be fixed to one surface of the recording medium while an image is already formed (fixed) on the other side of the recording medium P (i.e., in both-sided printing), the recording medium P is fed into the nip between the fixing sleeve 22 and the pressing roller 23 in a manner such that the pressing roller 23 is in contact with the side on which the image is already formed (fixed) and the fixing sleeve 22 is in contact with the side on which unfixed image is to be fixed.

The pressing roller 23 includes a core rod 23*a*, an elastic layer 23*b*, and a release layer (not shown). The core rod 23*a* is made of a metal material having high thermal conductivity such as aluminum or copper. The elastic layer 23*b* is made of a thermally-resistant material such as silicone rubber. The elastic layer 23*b* and the release layer are sequentially formed on the core rod 23*a*. For example, the outer diameter of the pressing roller 23 is 40 mm. For example, the thickness of the elastic layer 23*b* is 2 mm. For example, the release layer is made of PFA and has a tube-like shape for coating. For example, the thickness of the release layer is 50 μm. The pressing roller 23 is provided to be in press-contact with the fixing roller 21 via the fixing sleeve 22. When the pressing roller 23 is in press-contact with the fixing roller 21, a nip section is formed between the pressing roller 23 and the fixing roller 21. The recording medium P is fed into the nip section. The pressing roller 23 is a typical example of a pressing rotation body according to an embodiment of the present invention.

The induction heater 30 includes an exciting coil 31, a core 32, and a degaussing coil 33. The exciting coil 31 is formed by winding a Litz wire on a coil guide provided so as to cover a part of the outer periphery of the fixing sleeve 22. The Litz wire is made of a bundle of thin wires. As a result, the exciting coil 31 is formed so as to extend in the width direction of the recording medium P (i.e., extend in the direction orthogonal to the plane of the drawing sheet). The degaussing coil 33 is symmetrically disposed relative to the width direction of the recording medium P. Further, the degaussing coil 33 is provided on the exciting coil 31. The core 32 is made of a ferromagnetic body such as ferrite (having a relative permeability of approximately 2500). To form effective magnetic flux, the core 32 includes a center core 32*b*, a side core 32*a*, and an arch core 32*c*. The core 32 is provided so as to face the exciting coil 31 disposed in the width direction of the recording medium P (i.e., in the width direction of the fixing roller 21). Further, the induction heater 30 is a typical example of a heating unit according an embodiment of the present invention. The heating unit controls (heats) the temperature of the fixing sleeve 22.

The thermopile 34 is disposed substantially at the center part in the width direction of the fixing sleeve 22 in order to detect the temperature of the fixing sleeve 22. The thermopile 34 is a non-contact-type temperature sensor that can extremely accurately detect (measure) a temperature of a measurement target. Further, the thermopile 34 is a typical example of a temperature detection unit according an embodiment of the present invention. The temperature detection unit detects the temperature of the fixing rotation body according to an embodiment of the present invention.

The contact-type thermistor 35 is a temperature detection unit that detects a temperature of a non-sheet feeding region of the pressing roller 23. The contact-type thermistor 35 is disposed outside of a maximum-sheet-feeding region in the width direction of the pressing roller 23. Herein, the term "maximum-sheet-feeding region" refers to a region outside a passing region in the width direction of the pressing roller 23, the passing region being a region through which the recording medium having the maximum width is fed (passes) when the fixing device 20 is able to feed plural sizes of recording media such as A3T and A5T sheets having different sizes in the width direction from each other. By disposing the contact-type thermistor 35 outside the maximum-sheet-feeding region in the width direction of the pressing roller 23, it may become possible to prevent the damaging of the maximum-sheet-feeding region of the pressing roller 23. The contact-type thermistor 35 may be less expensive than the thermopile 34. On the other hand, the detection accuracy of the contact-type thermistor 35 may be less than that of the thermopile 34.

Figure 7:
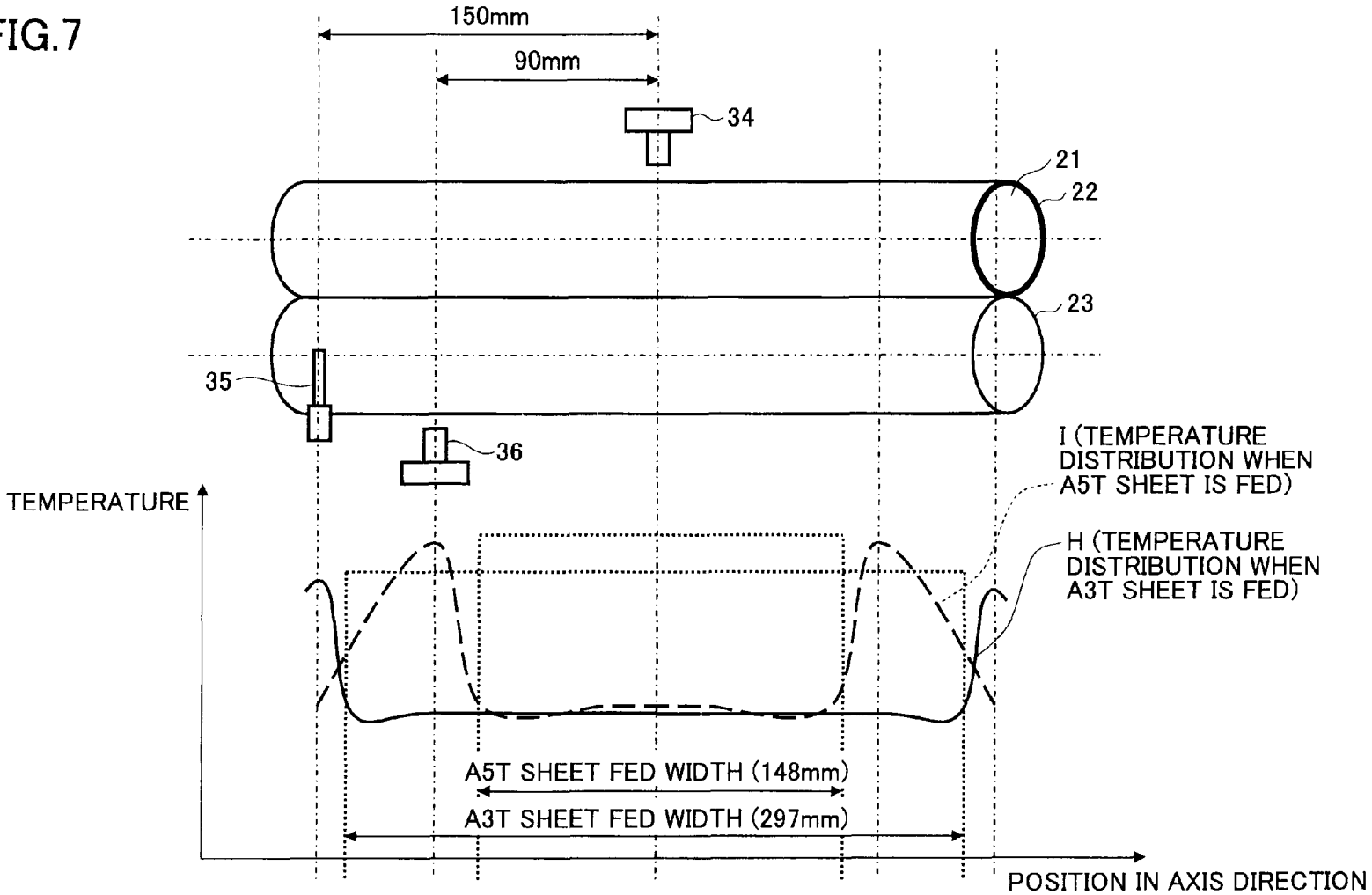
FIG. 7 is a drawing illustrating an example of the positions of temperatures detection units according the embodiment of the present invention.

The non-contact-type thermistor 36 is a temperature detection unit that detects a temperature of a sheet feeding region of the pressing roller 23. When compared with the contact-type thermistor 35, the non-contact-type thermistor 36 is disposed at a position closer to the center part in the width direction of the pressing roller 23. However, when the fixing device 20 is able to feed plural sizes of recording media such as A3T and A5T sheets having different sizes in the width direction from each other, the non-contact-type thermistor 36 may be disposed at a position corresponding to the non-sheet feeding region when a recording medium having a smaller width size (e.g., A5T sheet) is fed and corresponding to the sheet feeding region when a recording medium having a larger width size (e.g., A3T sheet) is fed (e.g., see the position of the non-contact-type thermistor 36 in FIG. 7). Namely, while the contact-type thermistor 35 is disposed outside the maximum-sheet-feeding region which is the non-sheet feeding region corresponding to any of the recording media P, the non-contact-type thermistor 36 is disposed in the sheet feeding region corresponding to at least the recording medium having the greatest width. Herein, the symbol "A3T" denotes a case where the recording medium having the A3 size is fed in the vertical direction (i.e., in a manner such that the longitudinal direction of the recording medium corresponds to the feeding direction of the recording medium). In the same manner, the symbol "A5T" denotes a case where the recording medium having the A5 size is fed in the vertical direction (i.e., in a manner such that the longitudinal direction of the recording medium corresponds to the feeding direction of the recording medium).

The non-contact-type thermistor 36 is provided in a manner such that the non-contact-type thermistor 36 is separated from the pressing roller 23 by a predetermined gap distance. Therefore, when compared with a contact-type temperature sensor contacting with the pressing roller 23, the non-contact-type thermistor 36 may have higher durability and may not cause inconvenience such as damage of the surface of the pressing roller 23. Further, the non-contact-type thermistor 36 may be less expensive than the thermopile 34. On the other hand, the detection accuracy of the non-contact-type thermistor 36 may be less than that of the thermopile 34. The contact-type thermistor 35 and the non-contact-type thermistor 36 constitute a typical example of plural temperature detection units that detect the temperature of the pressing rotation body.

A reason why two temperature detection units which are the contact-type thermistor 35 and the non-contact-type thermistor 36 are provided to detect the temperature of the pressing roller 23 is that a temperature distribution of the pressing roller 23 may not be uniform depending on a size of a feeding recording medium and the operation mode. Therefore, from the viewpoint of accurately detecting the temperature of the pressing roller 23, it is thought to be preferable to detect at least a temperature of the maximum-sheet-feeding region and a temperature outside the maximum-sheet-feeding region. In this case, in addition to the non-contact-type thermistor 36 to detect the temperature of the maximum-sheet-feeding region, another non-contact-type thermistor 36 as the temperature detection unit may further be disposed. By doing this, it may become possible to more accurately detect the temperatures of various positions of the pressing roller 23 in the axis direction of the pressing roller 23.

Next, an operation of the fixing device 20 having the above configuration is described. When the pressing roller 23 is rotationally driven by a drive motor (not shown) in the clockwise direction of FIG. 2, the fixing sleeve 22 rotates in the counterclockwise direction. Then, the fixing sleeve 22 is heated at the position facing the induction heater 30 due to the magnetic flux generated by the induction heater 30.

More specifically, by flowing an alternating current having a high frequency in a range from 10 kHz to 1 MHz (preferably in a range from 20 kHz to 800 kHz) through the exciting coil 31, magnetic lines of force are formed near the fixing sleeve 22 facing the exciting coil 31 in a manner such that the directions of the magnetic lines of force alternately change. Due to the generated alternating magnetic field, an eddy current is generated (excited) in the base material (heat generation layer) 22*a* of the fixing sleeve 22. As a result, the fixing sleeve 22 is induction-heated due to Joule heat which is generated by the excited eddy current and the electric resistance of the base material (heat generation layer) 22*a*. The surface of the fixing sleeve 22 heated by the induction heater 30 is fed (moved) to the nip section between the fixing sleeve (fixing roller 21) and the pressing roller 23. Then, the unfixed toner image (toner) T on the recording medium P fed to the nip section is heated and melted.

Specifically, the recording medium P carrying the toner image T as a result of predetermined image forming processes is guided by a guide plate 24 and fed into the nip section between the fixing roller 21 and the pressing roller 23 (i.e., the recording medium P is fed in the Y1 direction of FIG. 2). Then, the toner image T on the recording medium P is fixed onto the recording medium P due to the heat from the fixing roller 21 and the pressure from the pressing roller 23. Then, the recording medium P is fed from the nip section while separating from the fixing sleeve 22 by a fixing separation plate 25 and from the pressing roller 23 by a pressing separation plate 26. The surface of the fixing sleeve 22 passing through the nip section is returned to the position facing the induction heater 30.

Figure 8:
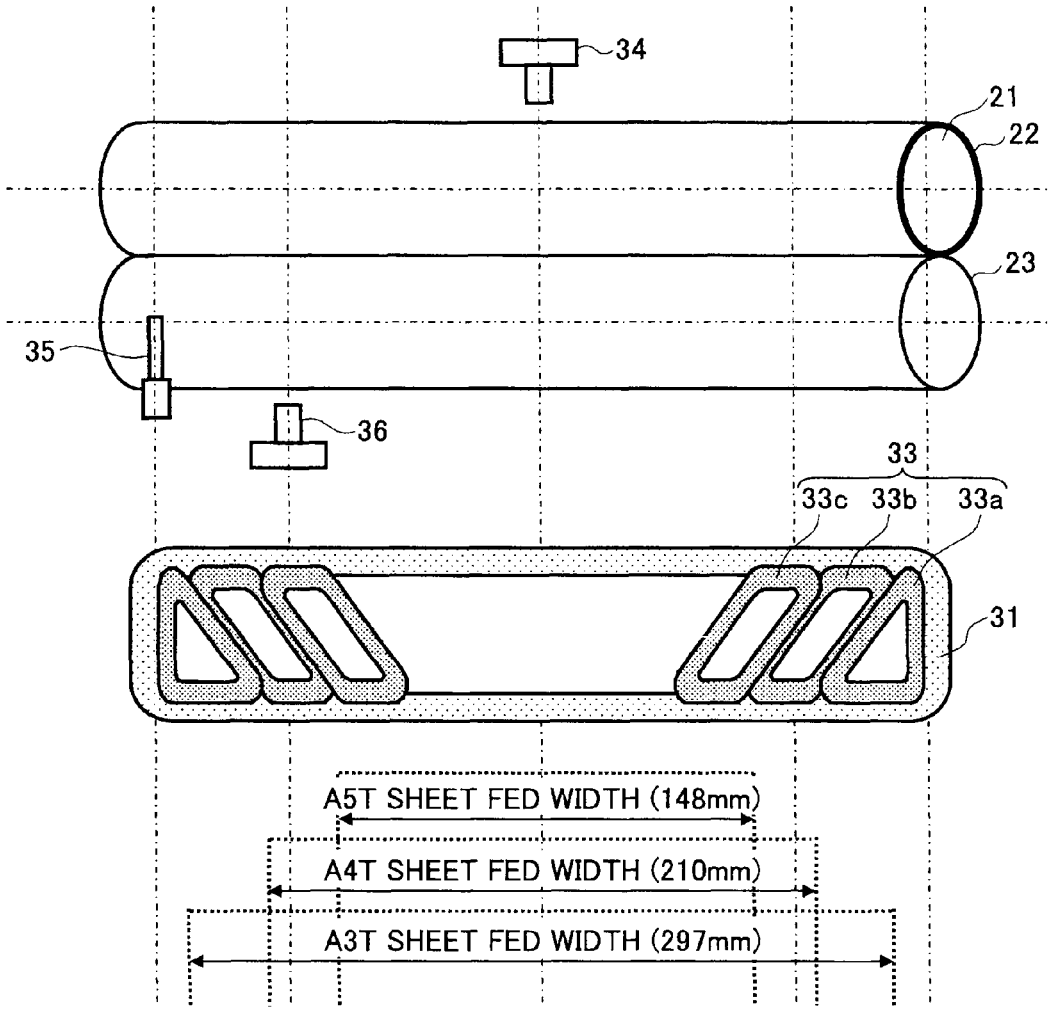
FIG. 8 is a drawing illustrating an example of heat width control of the fixing sleeve.

When sheets having a smaller size (e.g., A5T sheets) as the recording media P are continuously fed, the degaussing coil 33 is controlled to generate an alternating magnetic field opposite to the alternating magnetic field generated by the exciting coil 31 when, for example, a relay is turned ON by a control circuit (not shown). By doing this, the magnetic field on the region where the degaussing coil 33 is disposed is reduced. For example, as illustrated in FIG. 8, the degaussing coil 33 includes an outer degaussing coil 33*a*, a middle degaussing coil 33*b*, and an inner degaussing coil 33*c*. A detailed operation of the degaussing coil 33 is described below. Herein, the term "continuously fed" refers to a status where plural recording media P sequentially pass through the nip section between the fixing sleeve 22 and the pressing roller 23 at substantially regular intervals.

By repeating the series of the operations described above, the fixing process in the image forming process is finished.

The fixing device 20 includes a mechanism to change the pressing force from the pressing roller 23. Specifically, a pressure lever 44 to be in contact with the pressing roller 23 is rotatably provided relative to a center axle on one end side of the pressure lever 44. The other end side of the pressure lever 44 is in contact with a cam 41. By having this structure, when the cam 41 is rotatably driven by a driver (not shown), the pressure lever 44 moves substantially in the horizontal direction and the pressing force from the pressing roller 23 to the fixing sleeve 22 changes. For example, the driver includes a stepping motor and a reduction gear and the like.

Figure 4:
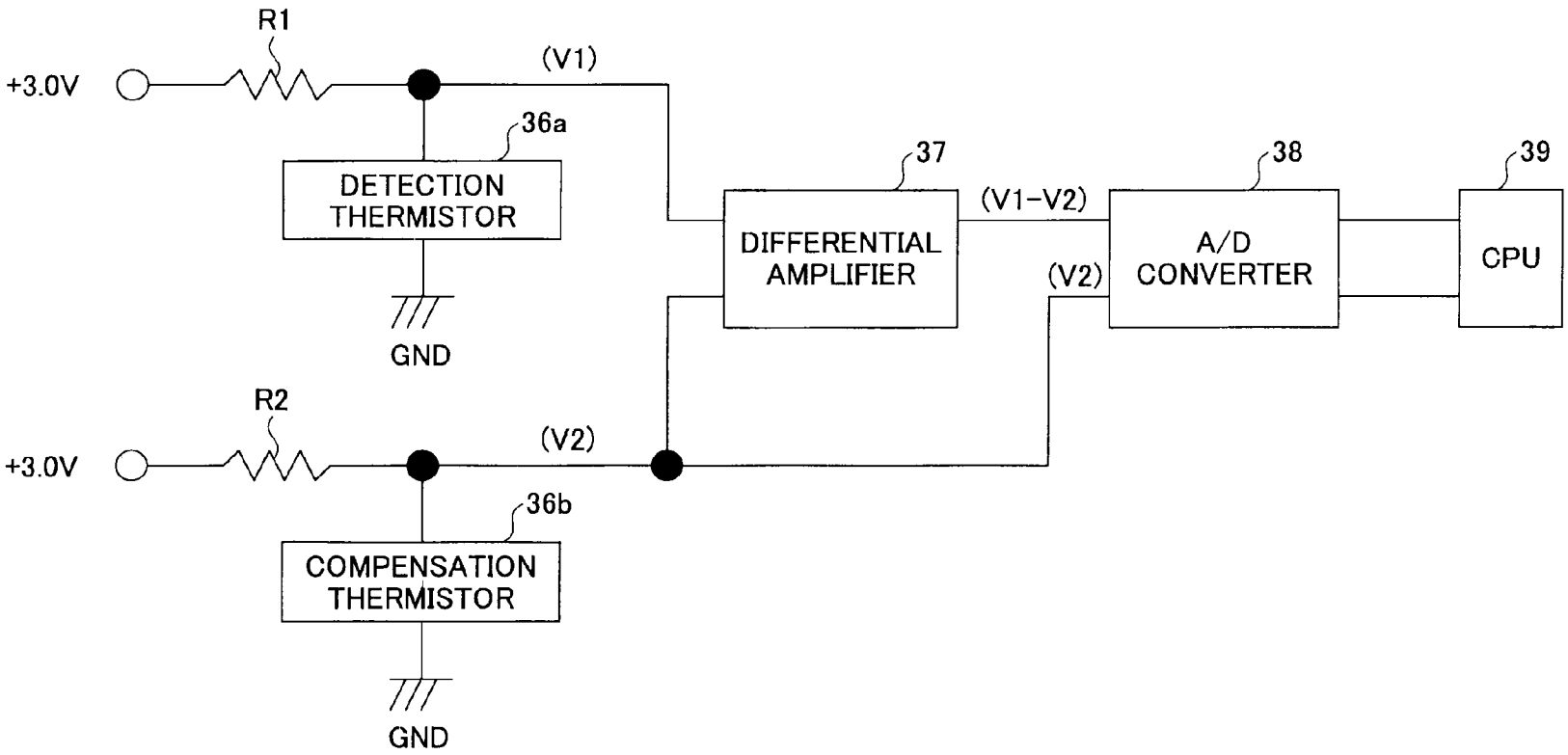
FIG. 4 is an example of a circuit diagram of a non-contact-type thermistor.

In the following, details of the characteristic configuration and operations of the fixing device according to this embodiment of the present invention are described. First, with reference to FIG. 4, an example of a circuit configuration of the non-contact-type thermistor 36 is described. As illustrated in FIG. 4, the non-contact-type thermistor 36 includes a detection thermistor 36*a* and a compensation thermistor 36*b*. The detection thermistor 36*a* detects the infrared radiation from the surface of the pressing roller 23. The compensation thermistor 36*b* detects the temperature of the detection thermistor 36*a*.

One terminal of each of the detection thermistor 36*a* and the compensation thermistor 36*b* is connected to GND (reference potential). The other terminals of the detection thermistor 36*a* and the compensation thermistor 36*b* are connected to power supplies via the resistors R1 and R2, respectively. In this embodiment, as an example, the detection thermistor 36*a* and the compensation thermistor 36*b* are connected to power supplies outputting +3.0 V via the resistors R1 and R2, respectively.

When the detection thermistor 36*a* and the compensation thermistor 36*b* detect the change of the temperature, the voltage V1 on the R1 side of the detection thermistor 36*a* and the voltage V2 on the R2 side of the compensation thermistor 36*b*, respectively, change. Both of the voltages V1 and V2 are input to a differential amplifier 37. The differential amplifier 37 amplifies and outputs a differential voltage (V1−V2) to an A/D converter 38. Further, the voltage V2 is also input to the A/D converter 38. The differential voltage (V1−V2) and the voltage V2 (which may also be referred to as a compensation voltage) are converted into digital signals by the A/D converter 38, and the converted digital signals are input to a CPU 39. The differential voltage (V1−V2) and the voltage V2 are converted into the detection temperatures by referring to a temperature table.

Figure 5:
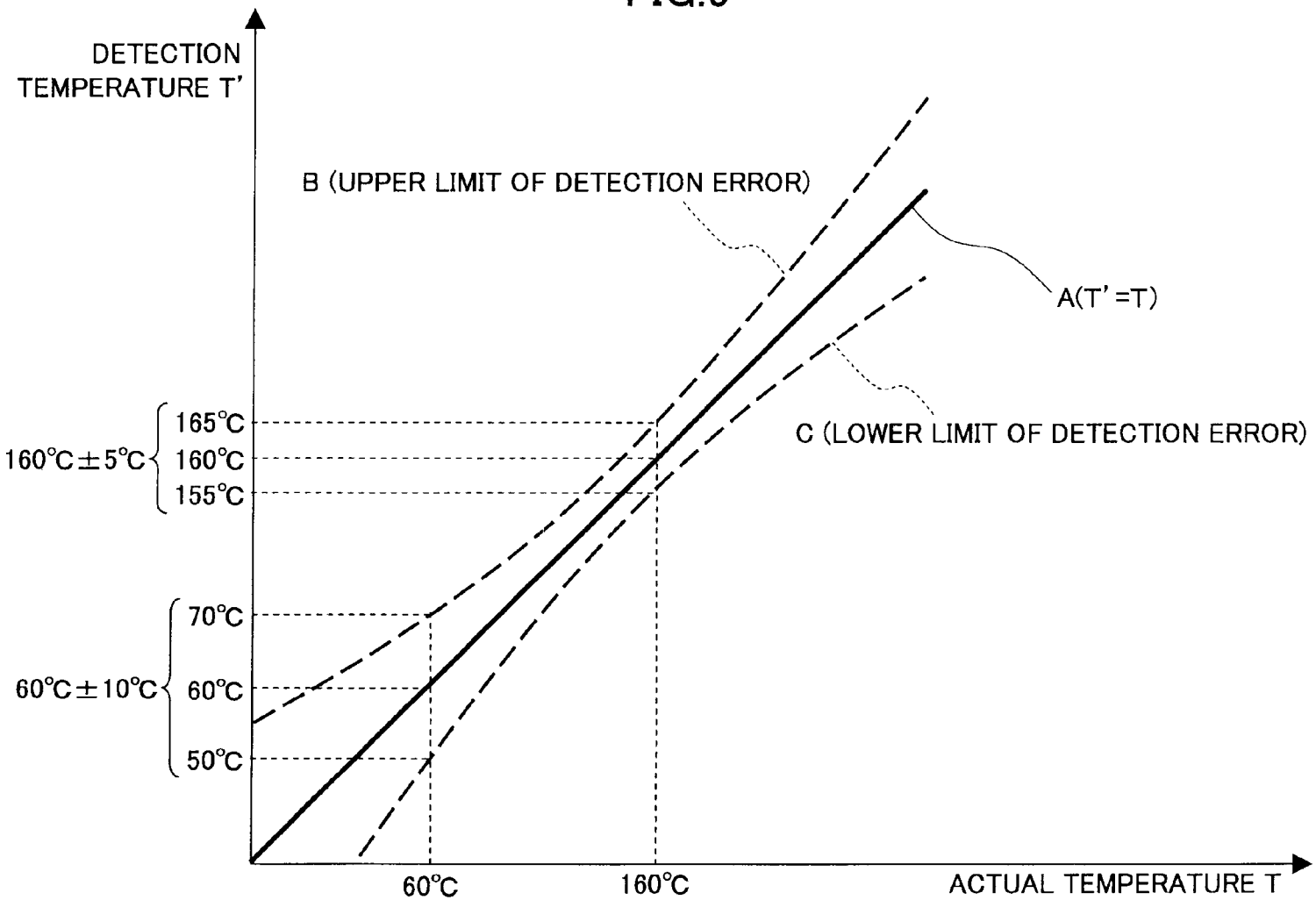
FIG. 5 is a graph illustrating a relationship between actual temperatures and detected temperatures detected by the non-contact-type thermistor.

Next, with reference to FIG. 5, a relationship between the actual temperature and the detection temperature of the surface of the pressing roller 23 is described. In the graph of FIG. 5, the lateral axis denotes the actual temperature T of the surface of the pressing roller 23. The vertical axis denotes the detection temperature T' detected by the non-contact-type thermistor 36. Further, the line A denotes a case where there is no detection error (i.e., there is no difference between the actual temperature T and the detection temperature T', (T=T')). The line B denotes the upper limit of the detection error and the line C denotes the lower limit of the detection error.

As illustrated in FIG. 5, the detection error of the non-contact-type thermistor 36 is not constant and varies depending on a temperature range to be used. In the example of FIG. 5, the detection error becomes the lowest which is approximately ±5° C. when the actual temperature T is around 160° C. Further, as the temperature is increased or lowered from 160° C., the detection error is increased. For example, when the actual temperature is around 60° C., the detection error is approximately ±10° C. On the other hand, the detection error of the contact-type thermistor 35 is substantially approximately ±3° C. in the entire use temperature range.

Figure 6:
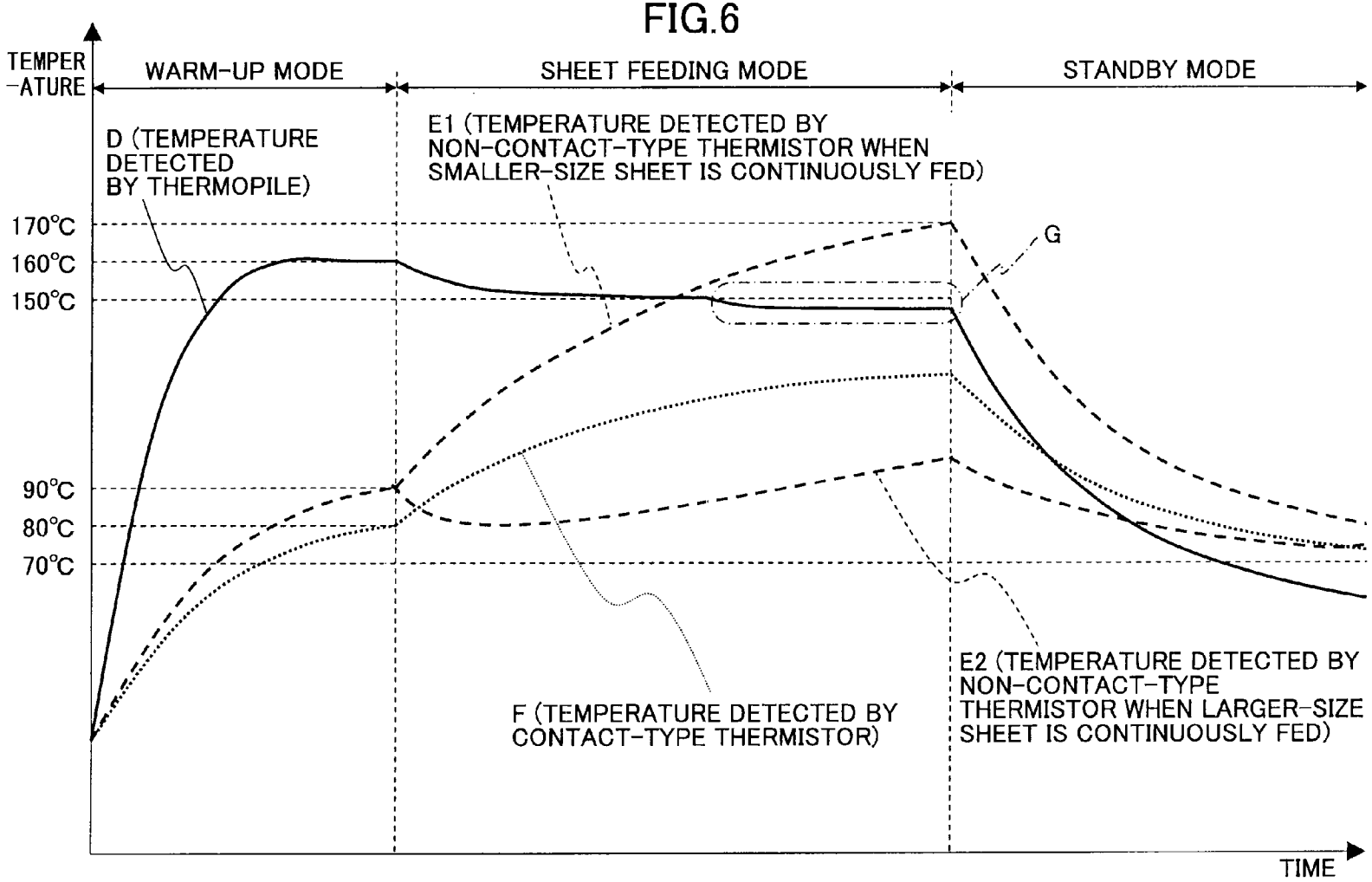
FIG. 6 is graph illustrating a temperature profile in various operation modes of the fixing device according to the embodiment of the present invention.

Next, with reference to FIG. 6, the operation mode of the fixing device according to the embodiment of the present invention is described. The operation mode of the fixing device includes the warm-up mode, the sheet feeding mode, the standby mode and the like. FIG. 6 illustrates a temperature increase profile of the fixing sleeve 22 and the pressing roller 23 when power of 1300 W is input into the fixing device 20 to start heating the fixing device 20 which is in a cold status (herein, the term cold status refers to a status where the temperature of the fixing device is 30° C. or less). In this example, the contact-type thermistor 35 is disposed at a position separated from the center of the pressing roller 23 by 150 mm in the axis direction, and the non-contact-type thermistor 36 is disposed at a position separated from the center of the pressing roller 23 by 90 mm in the axis direction (see FIG. 7). The contact-type thermistor 35 is disposed at a position in the non-sheet feeding region corresponding to any of the recording media P. On the other hand, the non-contact-type thermistor 36 is disposed at a position in the sheet feeding region corresponding to a larger-size sheet and in the non-sheet feeding region corresponding to a smaller-size sheet. Herein, the larger-size sheet refers to a recording medium having an A4T size or larger. The smaller-size sheet refers to a recording medium having an AST size or smaller. Further, the symbol "A4T" denotes a case where the recording medium having the A4 size is fed in the vertical direction (i.e., in a manner such that the longitudinal direction of the recording medium corresponds to the feeding direction of the recording medium).

In FIG. 6, the curve D denotes the temperature detected by the thermopile 34. The curve E1 denotes the temperature detected by the non-contact-type thermistor 36 when the smaller-size sheet is continuously fed. The curve E2 denotes the temperature detected by the non-contact-type thermistor 36 when the larger-size sheet is continuously fed. The curve F denotes the temperature detected by the contact-type thermistor 35.

First, a temperature profile in the warm-up mode is described. In the warm-up mode, the temperature of the fixing sleeve 22 is controlled by using the induction heater 30. In the warm-up operation to warm up (heat) the fixing device from the cold status (i.e., when the temperature of the fixing device is 30° C. or less), a temperature deviation of the pressing roller 23 in the axis direction is small. Further, a difference between the temperature detected by the contact-type thermistor 35 and the temperature detected by the non-contact-type thermistor 36 is within approximately 10° C. (see E1, E2, and F of FIG. 6). When the warm-up mode is finished, the operation mode changes into the sheet feeding mode when a print job is received, and the print job is started (i.e., it goes into a status where a sheet is fed). On the other hand, when no print job is received, the operation mode changes into the standby mode.

Next, a temperature profile when the warm-up mode is finished and the sheet feeding mode is started is described. When the larger-size sheet is continuously fed, the temperature detected by the non-contact-type thermistor 36 is temporarily reduced in the beginning of the continuous feed of the larger-size sheets. This is because the heat is transferred to the larger-size sheets. However, after that, the temperature is gradually increased due to the heat transferred from the fixing sleeve 22 (see E2 of FIG. 6). On the other hand, the temperature detected by the contact-type thermistor 35 is greatly increased. This is because the contact-type thermistor 35 is disposed in the non-sheet feeding region, and no heat is transferred to a sheet (see F of FIG. 6). In a case where the smaller-size sheet having an A5T size or smaller is continuously fed, the position of the non-contact-type thermistor 36 is in the non-sheet feeding region (see FIG. 7). The temperature then detected by the non-contact-type thermistor 36 is greatly increased because heat is not transferred to a sheet (see E1 of FIG. 6).

Next, a temperature profile when the sheet feeding mode is finished and the operation mode changes into the standby mode is described. In this case, the temperatures of the fixing sleeve 22 and the pressing roller 23 are gradually decreased, and the temperature deviation in the axis direction of the pressing roller 23 becomes smaller (see D, E1, E2, and F of FIG. 6).

Next, the temperature control in the warm-up mode, the sheet feeding mode, and the standby mode is described. In this embodiment, as an example, it is determined that the warm-up operation is finished when the temperature of the fixing sleeve 22 becomes 160° C. and the temperature of the pressing roller 23 at the position of the non-contact-type thermistor 36 becomes 90° C.

As described above with reference to FIG. 5, in a lower temperature range where a temperature is equal to or less than 100° C., the detection error in detecting the temperature by the non-contact-type thermistor 36 is relatively large. Therefore, it is preferable that the temperature of the pressing roller 23 is detected by using the contact-type thermistor 35 in the warm-up mode. It is known that in the warm-up mode, a difference between the temperature in the sheet feeding region and the temperature in the non-sheet feeding region is small. It is also known that when the temperature at an end of the pressing roller 23 (i.e. at the position of the contact-type thermistor 35) is 80° C., the temperature closer to the center of the pressing roller 23 (i.e. at the position of the non-contact-type thermistor 36) becomes 90° C. Therefore, based on the temperature detected by the contact-type thermistor 35, the temperature of the entire pressing roller 23 may be estimated. Namely, in this embodiment, whether the warm-up operation is finished (i.e. whether the operation mode is to be changed from the warm-up mode) is determined based on the temperature detected by the contact-type thermistor 35.

As described above, in the warm-up mode, the temperature of the pressing roller 23 is detected by using the contact-type thermistor 35. Further, based on the temperature detected by the contact-type thermistor 35, the temperature of the fixing sleeve 22 is controlled (i.e., the induction heater 30 is controlled) and a determination is made whether the warm-up mode is finished (i.e., whether the operation mode is to be changed from the warm-up mode). Namely, by using the contact-type thermistor 35 having relatively small detection error than that of the non-contact-type thermistor 36 in the lower temperature range equal to or less than 100° C., it may become possible to appropriately control the temperature of the fixing sleeve 22 (i.e., to appropriately control the induction heater 30) and correctly determine whether the warm-up mode is finished (i.e., whether the operation mode is to be changed from the warm-up mode).

On the other hand, in a case where, for example, the print jobs are frequently received and the temperature of the pressing roller 23 is 100° C. or higher (in a heated status), the temperature deviation in the axis direction is not always small. Therefore, it is preferable that the temperature is detected by using the non-contact-type thermistor 36 disposed in the sheet feeding region. This is because when the temperature is 100° C. or higher, the detection error of the non-contact-type thermistor 36 is within approximately ±5° C. As described above, depending on the temperature detected by the non-contact-type thermistor 36, it may become possible to select and use the contact-type thermistor 35 or the non-contact-type thermistor 36 to detect the temperature of the pressing roller 23.

Further, as the temperature detection unit to be used to first detect temperature, either the contact-type thermistor 35 or the non-contact-type thermistor 36 may be used. In the following, a case is described where when the temperature of the pressing roller 23 is less than 100° C., the temperature of the fixing sleeve 22 is controlled and the operation mode is changed based on the temperature detected by the contact-type thermistor 35, and when the temperature of the pressing roller 23 is equal to or greater than 100° C., the temperature of the fixing sleeve 22 is controlled and the operation mode is changed based on the temperature detected by the non-contact-type thermistor 36. In this case, it is assumed that the non-contact-type thermistor 36 is first used to determine whether the temperature of the pressing roller 23 is equal to or greater than 100° C. In this case, when the actual temperature is less than 100° C., the temperature detected by the non-contact-type thermistor 36 includes relatively large detection error. However, after this first detection, the contact-type thermistor 35 having relatively small detection error is selected and used. Therefore, it is thought that no problem occurs.

In the sheet feeding mode, the temperature of the pressing roller 23 is detected by using the non-contact-type thermistor 36. Then, based on the temperature detected by the non-contact-type thermistor 36, the temperature of the fixing sleeve 22 is controlled (i.e., the induction heater 30 is controlled) and the determination is made whether the operation mode is to be changed. This is because, in the sheet feeding mode, the temperature of the sheet feeding region may largely differ from the temperature of the non-sheet feeding region. Therefore, the contact-type thermistor 35 disposed in the non-sheet feeding region may not correctly detect the temperature of the pressing roller 23 in this sheet feeding mode. Further, in the sheet feeding mode, the temperature of the pressing roller 23 is increased to a temperature in a temperature range where the detection error of the non-contact-type thermistor 36 is relatively small. Therefore, the temperature may be accurately detected by the non-contact-type thermistor 36.

Next, a temperature control method depending on the size of the recording medium in the sheet feeding mode is described. In the sheet feeding mode, a temperature control method when the smaller-size sheet having the A5T size or smaller may differ from a temperature control method when the larger-size sheet having the A4T size or larger is fed.

The fixing device 20 includes the controller (not shown). The controller includes a detection unit (not shown) that detects the width of a feeding recording medium. Further, the induction heater 30 heats a region of the fixing sleeve 22, the region corresponding to the width detected by the detection unit of the controller. The detection unit (not shown) may detect a feeding range (i.e., the width of the feeding recording medium) in the current JOB (print job) based on, for example, information from a CPU (not shown) of the controller (not shown).

For example, it is assumed that the detection unit has detected that the width of the feeding recording medium is equal to or less than the width of the A5T sheet. When the recording medium having the A5T size or smaller is fed, the position of the non-contact-type thermistor 36 is in the non-sheet feeding region (see FIG. 7). Therefore, when the temperature detected by the non-contact-type thermistor 36 is increased, power is supplied to the outer degaussing coil 33*a* and the middle degaussing coil 33*b* illustrated in FIG. 8. By doing this, it may become possible to prevent overheating of the non-sheet feeding region of the fixing sleeve 22 (i.e., a region corresponding to the region where the outer degaussing coil 33*a* and the middle degaussing coil 33*b* are disposed) and heat only a region of the fixing sleeve 22, the region corresponding to the width detected by the detection unit of the controller (i.e., the sheet feeding region).

Next, it is assumed that the detection unit has detected that the width of the feeding recording medium is equal to that of the A4T sheet. In the case where the recording medium having the A4t size is fed, when the temperature detected by the contact-type thermistor 35 is increased, power is supplied to the outer degaussing coil 33*a*. By doing this, it may become possible to prevent overheating of the non-sheet feeding region of the fixing sleeve 22 (i.e., a region corresponding to the region where the outer degaussing coil 33*a* is disposed) and heat only a region of the fixing sleeve 22, the region corresponding to the width detected by the detection unit of the controller (i.e., the sheet feeding region).

Next, it is assumed that the detection unit has detected that the width of the feeding recording medium is equal to that of the A3T (A4Y) sheet. In the case where the recording medium having the A3T (A4Y) size is fed, when the temperature detected by the contact-type thermistor 35 is increased, no power is supplied to any of the outer degaussing coil 33*a*, the middle degaussing coil 33*b*, and the inner degaussing coil 33*c*. Namely, the entire fixing sleeve 22 in the axis direction is heated by the induction heater 30. Herein, the symbol "A4Y" denotes a case where the recording medium having the A4 size is fed in the lateral direction (i.e., in a manner such that the lateral direction orthogonal to the longitudinal direction of the recording medium corresponds to the feeding direction of the recording medium).

Further, in a case where a recording medium having the A3T (A4Y) is fed, when the temperature detected by the contact-type thermistor 35 is increased, it is determined that the temperature of the center of the pressing roller 23 is also increased. Then, the temperature of the fixing sleeve 22 is reduced by 2° C. (see part G of FIG. 6). When the temperature of the sheet feeding region of the fixing sleeve 22 is increased, a heat amount more than necessary may be supplied to toner. Therefore, by reducing the temperature of the fixing sleeve 22, energy consumption may be reduced.

Namely, in order to fix toner, the temperature of the fixing sleeve 22 is controlled while the recording medium is fed. On the other hand, a necessary temperature of the fixing sleeve 22 may vary depending on a heat amount accumulated in the pressing roller 23. Therefore, the heat amount accumulated in the pressing roller 23 is detected by using the contact-type thermistor 35 disposed in the non-sheet feeding region where the heat amount accumulated in the pressing roller 23 may be stably detected regardless of a feeding history. In a case where the detected heat amount accumulated in the pressing roller 23 is large, even when the temperature of the fixing sleeve 22 is reduced, toner may be fixed. Therefore, in such a case, by reducing the temperature of the fixing sleeve 22, consumption of energy may be reduced.

As described above, when the detection unit detects that the width of the recording medium is less than a predetermined value (e.g., when the predetermined value corresponds to the width of the A4T sheet, and the width of A5T sheet is detected by the detection unit), an appropriate power is supplied to any or all of the outer degaussing coil 33*a*, the middle degaussing coil 33*b*, and the inner degaussing coil 33*c*. By doing this, it may become possible that the induction heater 30 heats an appropriate region of the fixing sleeve 22, the region corresponding the detected width of the recording medium. On the other hand, when the detection unit detects that the width of the recording medium is equal to or greater than the predetermined value (e.g., when the predetermined value corresponds to the width of the A4T sheet, and the width of A4T or A3T sheet is detected by the detection unit), an appropriate power is supplied to any or all of the outer degaussing coil 33*a*, the middle degaussing coil 33*b*, and the inner degaussing coil 33*c*. By doing this, it may become possible that the induction heater 30 heats an appropriate region of the fixing sleeve 22, the region corresponding the detected width of the recording medium.

In this method, even when it is difficult to detect a local temperature increase of the fixing sleeve 22 at a region corresponding to an edge of the sheet, a temperature of the pressing roller 23 locally increased due to the heat from the fixing sleeve 22 may be detected by using the non-contact-type thermistor 36 disposed in the sheet feeding region or the contact-type thermistor 35 disposed in the non-sheet feeding region. As a result, it may become possible to obtain temperature information necessary to control a heat amount to heat a region of the fixing sleeve 22 from the pressing roller 23 side, the region corresponding to the width of the recording medium, and perform appropriate control of the heat amount.

In the standby mode, a target temperature of the pressing roller 23 is 70° C., which is in a temperature range where the detection error of the non-contact-type thermistor 36 is relatively large. Therefore, the temperature detected by the contact-type thermistor 35 is used to control the temperature of the pressing roller 23 and determine whether the operation mode is to be changed. To control the temperature of the pressing roller 23, a halogen heater (not shown) in the pressing roller 23 may be used. In the standby mode, the temperature deviation of the pressing roller 23 in the axis direction is relatively small. Therefore, it is thought that no problem occurs. Further, in the standby mode, the temperature of the fixing sleeve 22 is not controlled.

As described above, in this embodiment, depending on the operation mode of the fixing device 20, a predetermined temperature detection unit is selected from the contact-type thermistor 35 and the non-contact-type thermistor 36 detecting the temperature of the pressing roller 23. (However, any other appropriate temperature detection unit may alternatively be selected.) Then, by using the selected temperature detection unit, the temperature of the pressing roller 23 is detected. Herein, in this embodiment, unlike the related art (where whether the operation mode is to be changed and the like is determined based on the detected temperature of the fixing roller 21), the temperature of the pressing roller 23 is detected. Then, whether the operation mode is to be changed and the like is determined based on the detected temperature of the pressing roller 23. A reason why whether the warm-up operation is finished is determined not based on the detection temperature of the fixing roller 21 but based on the detection temperature of the pressing roller 23 is described.

The temperature of the surface of the pressing roller 23 is increased when heat is transferred from the fixing sleeve 22. At the same time, the heat in the fixing sleeve 22 is also transferred into the fixing roller 21 and accumulated in the fixing roller 21. Because of this feature, even in a case where the temperature of the surface of the fixing sleeve 22 reaches a predetermined temperature, when sufficient heat is not accumulated in the fixing roller 21, there may be a case where the temperature of the surface of the pressing roller 23 does not reach a predetermined temperature. In other words, when the temperature of the surface of the pressing roller 23 reaches the predetermined temperature, it may be possible to determine that sufficient heat is accumulated in the fixing roller 21. Therefore, in this embodiment of the present invention, whether sufficient heat is accumulated in the fixing roller 21 is estimated (determined) by detecting the temperature of the surface of the pressing roller 23. Then, based on the result of detecting the temperature of the surface of the pressing roller 23, whether the operation mode is to be changed and the like is determined. As a result, it may become possible to appropriately determine whether the operation mode is to be changed and the like. Namely, it may become possible to start a fixing operation under the condition that sufficient heat is accumulated in the fixing roller 21.

Based on the disclosed technique according to the embodiment of the present invention, it may become possible to provide a fixing device that accurately detects the temperature in any temperature range and an image forming apparatus including the fixing device.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

For example, in the above description, a case is described where the fixing device includes the fixing roller, the pressing roller, IH (Induction Heater) coil and the like. However, the present invention is not limited to such a configuration. For example, the present invention may also be applied to a fixing device including a fixing belt stretched between the fixing roller and the pressing roller. Further, the present invention may also be applied to a fixing device including a nip forming member and a slidable fixing belt, where plural thermistors are provided for the pressing roller.

Further, in the above description, a case is described where the image forming apparatus is a laser printer. However, the image forming apparatus of the present invention is not limited to the laser printer. For example, the image forming apparatus of the present invention may be a copier, any printers other than the laser printer, a facsimile machine, a printing machine and the like.

What is claimed is:

1. A fixing device comprising:

a fixing rotation body configured to be in contact with a side of a recording medium, an unfixed image having been formed on the side of the recording medium, and heat and fix the unfixed image onto the recording medium;

a pressing rotation body configured to be in contact with another side of the recording medium, no unfixed image having been formed on the other side of the recording medium, and press the recording medium to the fixing rotation body;

a first temperature detector configured to detect a temperature of the fixing rotation body; and plural second temperature detectors configured to detect a temperature of the pressing rotation body;

wherein the fixing device selects a predetermined second temperature detector from the plural second temperature detectors depending on an operation mode of the fixing device, wherein the fixing device detects the temperature of the pressing rotation body by using the predetermined second temperature detector selected by the fixing device, wherein the plural second temperature detectors include a non-contact-type thermistor configured to detect a temperature of a sheet feeding region of the pressing rotation body and a contact-type thermistor configured to detect a temperature of a non-sheet feeding region of the pressing rotation body, the fixing device further comprising:

a detector configured to detect a width of the recording medium; and a heater to heat a region of the fixing rotation body, the region corresponding to the width detected by the detector, wherein the fixing device feeds any of plural types of recording media having different widths from each other, and wherein the heater heats the region based on the temperature detected by the non-contact-type thermistor, when the non-contact-type thermistor is used to detect a temperature of a non-sheet feeding region of the pressing rotation body.

2. The fixing device according to claim 1, wherein when a temperature first detected by any of the plural second temperature detectors is less than a predetermined temperature, the fixing device controls the temperature of the fixing rotation body and the temperature of the pressing rotation body and determines to change the operation mode based on the temperature detected by the contact-type thermistor and wherein when the temperature first detected by any of the plural second temperature detectors is equal to or greater than the predetermined temperature, the fixing device controls the temperature of the fixing rotation body and the temperature of the pressing rotation body and determines to change the operation mode based on the temperature detected by the non-contact-type thermistor.

3. The fixing device according to claim 1, wherein the operation mode includes a warm-up mode and a sheet feeding mode, wherein, in the warm-up mode, the fixing device controls the temperature of the fixing rotation body and determines to change the operation mode based on the temperature detected by the contact-type thermistor, and wherein, in the sheet feed mode, the fixing device controls the temperature of the fixing rotation body and determines to change the operation mode based on the temperature detected by the non-contact-type thermistor.

4. The fixing device according to claim 3, wherein the operation mode further includes a standby mode, and wherein, in the standby mode, the fixing device controls the temperature of the pressing rotation body and determines to change the operation mode based on the temperature detected by the contact-type thermistor.

5. The fixing device according to claim 1, wherein the fixing device detects a heat amount accumulated in the pressing rotation body by using the contact-type thermistor in the non-sheet feeding region of the pressing rotation body, and wherein the fixing device controls a heat amount to be added to the fixing rotation body based on the heat amount detected by using the contact-type thermistor.

6. An image forming apparatus comprising:

the fixing device according to claim 1.

7. The fixing device according to claim 1, wherein:

the detector is configured to acquire the width based on information from a CPU of the fixing device.

8. A fixing device comprising:

a fixing rotation body configured to be in contact with a side of a recording medium, an unfixed image having been formed on the side of the recording medium, and heat and fix the unfixed image onto the recording medium;

a pressing rotation body configured to be in contact with another side of the recording medium, no unfixed image having been formed on the other side of the recording medium, and press the recording medium to the fixing rotation body;

a first temperature detector configured to detect a temperature of the fixing rotation body; and plural second temperature detectors configured to detect a temperature of the pressing rotation body;

wherein the fixing device selects a predetermined second temperature detector from the plural second temperature detectors depending on an operation mode of the fixing device, wherein the fixing device detects the temperature of the pressing rotation body by using the predetermined second temperature detector selected by the fixing device, wherein the plural second temperature detectors include a non-contact-type thermistor configured to detect a temperature of a sheet feeding region of the pressing rotation body and a contact-type thermistor configured to detect a temperature of a non-sheet feeding region of the pressing rotation body, the fixing device further comprising:

a detector configured to detect a width of the recording medium; and a heater to heat a region of the fixing rotation body, the region corresponding to the width detected by the detector, wherein the fixing device feeds any of plural types of recording media having different widths from each other, and wherein the heater heats the region based on the temperature detected by the non-contact-type thermistor when the non-contact-type thermistor detects a temperature of a non-sheet feeding region of the pressing rotating body, and wherein the heater heats the region based on the temperature detected by the contact-type thermistor when the non-contact-type thermistor detects a temperature of a sheet feeding region of the pressing rotation body.

9. The fixing device according to claim 8, wherein:

the detector is configured to acquire the width based on information from a CPU of the fixing device.

10. A fixing device comprising:

a fixing rotation body configured to be in contact with a side of a recording medium, an unfixed image having been formed on the side of the recording medium, and heat and fix the unfixed image onto the recording medium;

a pressing rotation body configured to be in contact with another side of the recording medium, no unfixed image having been formed on the other side of the recording medium, and press the recording medium to the fixing rotation body;

a first temperature detector configured to detect a temperature of the fixing rotation body; and plural second temperature detectors configured to detect a temperature of the pressing rotation body;

wherein the fixing device selects a predetermined second temperature detector from the plural second temperature detectors depending on an operation mode of the fixing device, wherein the fixing device detects the temperature of the pressing rotation body by using the predetermined second temperature detector selected by the fixing device, wherein the plural second temperature detectors include a non-contact-type thermistor configured to detect a temperature of a sheet feeding region of the pressing rotation body and a contact-type thermistor configured to detect a temperature of a non-sheet feeding region of the pressing rotation body, the fixing device further comprising:

a heater to heat a region of the fixing rotation body, the region corresponding to a width detected of the recording medium, the width being based on width information acquired from a controller outside the fixing device, wherein the fixing device feeds any of plural types of recording media having different widths from each other, and wherein the heater heats the region based on the temperature detected by the non-contact-type thermistor, when the non-contact-type thermistor is used to detect a temperature of a non-sheet feeding region of the pressing rotation body.

11. An image forming apparatus comprising:

the fixing device according to claim 10.

* * * * *